US007455390B2

(12) United States Patent
Silverbrook

(10) Patent No.: US 7,455,390 B2
(45) Date of Patent: Nov. 25, 2008

(54) PRINTHEAD ASSEMBLY WITH A MOUNTING CHANNEL HAVING A SILICON CORE

(75) Inventor: Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 71 days.

(21) Appl. No.: 11/281,444

(22) Filed: Nov. 18, 2005

(65) Prior Publication Data

US 2006/0066673 A1 Mar. 30, 2006

Related U.S. Application Data

(63) Continuation of application No. 10/943,873, filed on Sep. 20, 2004, now Pat. No. 7,204,580, which is a continuation of application No. 10/636,271, filed on Aug. 8, 2003, now Pat. No. 6,802,594, which is a continuation of application No. 10/129,437, filed as application No. PCT/AU01/00260 on Mar. 9, 2001, now Pat. No. 6,793,323.

(30) Foreign Application Priority Data

Feb. 9, 2000 (AU) ..... PQ6111

(51) Int. Cl.
*B41J 2/155* (2006.01)
*B41J 2/14* (2006.01)
*B41J 2/16* (2006.01)

(52) U.S. Cl. ..... 347/42; 347/49

(58) Field of Classification Search ..... 347/49, 347/42

See application file for complete search history.

(56) References Cited

U.S. PATENT DOCUMENTS

| | | | | |
|---|---|---|---|---|
| 3,959,062 | A * | 5/1976 | Hoh et al. | 156/313 |
| 5,528,272 | A | 6/1996 | Quinn et al. | |
| 5,734,394 | A | 3/1998 | Hackleman | |
| 5,818,478 | A | 10/1998 | Gibson | |
| 6,068,367 | A * | 5/2000 | Fabbri | 347/49 |
| 6,250,738 | B1 * | 6/2001 | Waller et al. | 347/42 |
| 6,339,881 | B1 | 1/2002 | Fisher et al. | |
| 6,449,831 | B1 | 9/2002 | Komplin et al. | |
| 6,575,561 | B1 | 6/2003 | Silverbrook | |

FOREIGN PATENT DOCUMENTS

| | | | |
|---|---|---|---|
| JP | 11-010861 | A | 1/1999 |
| JP | 2000-280496 | A | 10/2000 |
| WO | WO 99/65691 | A | 12/1999 |

* cited by examiner

*Primary Examiner*—Julian D Huffman

(57) ABSTRACT

The present invention relates to a printhead assembly. The printhead assembly includes a metal body defining a channel and a silicon core located within the channel. One or more printhead modules mounted to the silicon core are also provided. In one embodiment, each printhead module may include an integrated circuit and at least one fiducial for aligning the printhead.

5 Claims, 1 Drawing Sheet

PRINTHEAD ASSEMBLY WITH A MOUNTING CHANNEL HAVING A SILICON CORE

CROSS REFERENCED AND RELATED APPLICATIONS

This is a continuation of Ser. No. 10/943,873 filed Sep. 20, 2004 now U.S. Pat. No. 7,204,580, which is a continuation of Ser. No. 10/636,271 filed Aug. 8, 2003 now issued as U.S. Pat. No. 6,802,594 which is a continuation of U.S. Ser. No. 10/129,437 filed May 6, 2002 now issued as U.S. Pat. No. 6,793,323 which is a 371 of PCT/AU01/00260 filed on Mar. 9, 2001.

FIELD OF THE INVENTION

The present invention relates to printers, and in particular to digital inkjet printers.

CO-PENDING APPLICATIONS

Various methods, systems and apparatus relating to the present invention are disclosed in the following co-pending applications filed by the applicant or assignee of the present invention on 24 May 2000:

| | | |
|---|---|---|
| PCT/AU00/00578 | PCT/AU00/00579 | PCT/AU00/00581 |
| PCT/AU00/00580 | PCT/AU00/00582 | PCT/AU00/00587 |
| PCT/AU00/00588 | PCT/AU00/00589 | PCT/AU00/00583 |
| PCT/AU00/00593 | PCT/AU00/00590 | PCT/AU00/00591 |
| PCT/AU00/00592 | PCT/AU00/00584 | PCT/AU00/00585 |
| PCT/AU00/00586 | PCT/AU00/00594 | PCT/AU00/00595 |
| PCT/AU00/00596 | PCT/AU00/00597 | PCT/AU00/00598 |
| PCT/AU00/00516 | PCT/AU00/00517 | PCT/AU00/00511 |

Various methods, systems and apparatus relating to the present invention are disclosed in the following co-pending application, PCT/AU00/01445, filed by the applicant or assignee of the present invention on 27 Nov. 2000. The disclosures of these co-pending applications are incorporated herein by cross-reference. Also incorporated by cross-reference are the disclosures of two co-filed PCT applications, PCT/AU01/00261 and PCT/AU01/00259 (deriving priority from Australian Provisional Patent Application No. PQ6110 and PQ6158). Further incorporated are the disclosures of two co-pending PCT applications filed 6 Mar. 2001, application numbers PCT/AU01/00238 and PCT/AU01/00239, which derive their priority from Australian Provisional Patent Application nos. PQ6059 and PQ6058.

BACKGROUND OF THE INVENTION

Recently, inkjet printers have been developed which use printheads manufactured by micro-electro mechanical systems (MEMS) techniques. Such printheads have arrays of microscopic ink ejector nozzles formed in a silicon chip using MEMS manufacturing techniques. The invention will be described with particular reference to silicon printhead chips for digital inkjet printers wherein the nozzles, chambers and actuators of the chip are formed using MEMS techniques. However, it will be appreciated that this is in no way restrictive and the invention may also be used in many other applications.

Silicon printhead chips are well suited for use in pagewidth printers having stationary printheads. These printhead chips extend the width of a page instead of traversing back and forth across the page, thereby increasing printing speeds. The probability of a production defect in an eight inch long chip is much higher than a one inch chip. The high defect rate translates into relatively high production and operating costs.

To reduce the production and operating costs of pagewidth printers, the printhead may be made up of a series of separate printhead modules mounted adjacent one another, each module having its own printhead chip. To ensure that there are no gaps or overlaps in the printing produced by adjacent printhead modules it is necessary to accurately align the modules after they have been mounted to a support beam. Once aligned, the printing from each module precisely abuts the printing from adjacent modules.

Unfortunately, the alignment of the printhead modules at ambient temperature will change when the support beam expands as it heats up to the temperature it maintains during operation.

SUMMARY OF THE INVENTION

Accordingly, the present invention provides a system for aligning two or more printhead modules mounted to a support member in a printer, the system including:

positioning the printhead modules on the support member such that they align when the support member is at its operating temperature but not necessarily at other temperatures.

Preferably, the support member is a beam and the printhead modules include MEMS manufactured chips having at least one fiducial on each;

wherein, the fiducials are used to misalign the printhead modules by a distance calculated from:

i) the difference between the coefficient of thermal expansion of the beam and the printhead chips;

ii) the spacing of the printhead chips along the beam; and, iii) the difference between the production temperature and the operating temperature.

Conveniently, the beam may have a core of silicon and an outer metal shell. In a further preferred embodiment, the beam is adapted to allow limited relative movement between the silicon core and the metal shell. To achieve this, the beam may include an elastomeric layer interposed between the silicon core and metal shell. In other forms, the outer shell may be formed from laminated layers of at least two different metals.

It will be appreciated that this system requires the coefficient of thermal expansion of the printhead chips to be greater than or equal to the coefficient of thermal expansion of the beam, otherwise the "gaps" left between the printhead modules as compensation at ambient temperature will not close as the beam reaches the operating temperature.

BRIEF DESCRIPTION OF THE DRAWING

A preferred embodiment of the invention will now be described, by way of example only, with reference to the accompanying drawing in which.

DETAILED DESCRIPTION OF PREFERRED EMBODIMENTS

Figure 1:
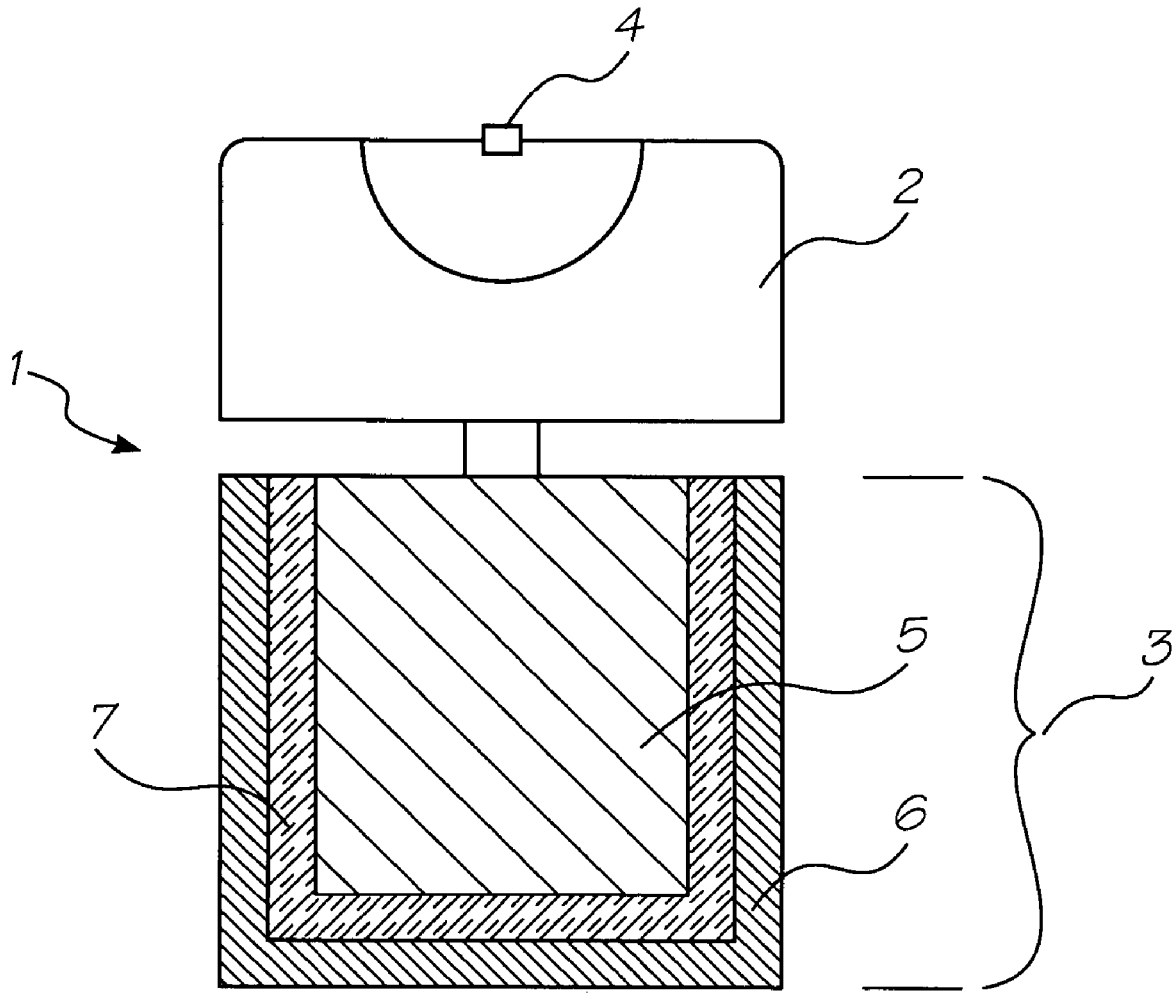
FIG. 1 shows a schematic cross section of a printhead assembly according to the present invention.

Referring to the figure the printhead assembly 1 has a plurality of printhead modules 2 mounted to a support member 3 in a printer (not shown). The printhead module includes a silicon printhead chip 4 in which the nozzles, chambers, and actuators are manufactured using MEMS techniques. Each printhead chip 4 has at least 1 fiducial (not shown) for aligning the printheads. Fiducials are reference markings placed on silicon chips and the like so that they may be accurately positioned using a microscope.

According to one embodiment of the invention, the printheads are aligned while the printer is operational and the assembly is at the printing temperature. If it is not possible to view the fiducial marks while the printer is operating, an alternative system of alignment is to misalign the printhead modules on the support beam 3 such that when the printhead assembly heats up to the operating temperature, the printheads move into alignment. This is easily achieved by adjusting the microscope by the set amount of misalignment required or simply misaligning the printhead modules by the required amount.

The required amount is calculated using the difference between the coefficients of thermal expansion of the printhead modules and the support beam, the length of each individual printhead module and the difference between ambient temperature and the operating temperature. The printer is designed to operate with acceptable module alignment within a temperature range that will encompass the vast majority of environments in which it expected to work. A typical temperature range may be 0° C. to 40° C. During operation, the operating temperature of the printhead rise a fixed amount above the ambient temperature in which the printer is operating at the time. Say this increase is 50° C., the temperature range in which the alignment of the modules must be within the acceptable limits is 50° C. to 90° C. Therefore, when misaligning the modules during production of the printhead, the production temperature should be carefully maintained at 20° C. to ensure that the alignment is within acceptable limits for the entire range of predetermined ambient temperatures (i.e. 0° C. to 40° C.).

To minimize the difference in coefficient of thermal expansion between the printhead modules and the support beam 3, the support beam has a silicon core 5 mounted within a metal channel 6. The metal channel 6 provides a strong cost effective structure for mounting within a printer while the silicon core provides the mounting points for the printhead modules and also helps to reduce the coefficient of thermal expansion of the support beam 3 as a whole. To further isolate the silicon core from the high coefficient of thermal expansion in the metal channel 6 an elastomeric layer 7 is positioned between'the core 5 and the channel 6. The elastomeric layer 7 allows limited movement between the metal channel 6 and the silicon core 5.

The invention has been described with reference to specific embodiments. The ordinary worker in this field will readily recognize that the invention may be embodied in many other forms.

The invention claimed is:

1. A printhead assembly that comprises:

a metal body defining a channel;

a silicon core located within the channel; and one or more printhead modules mounted to and spaced apart from the silicon core so as to form an air gap between the one or more printhead modules and the silicon core;

wherein the one or more printhead modules are moveably mountable in a lateral direction with respect to the silicon core.

2. A printhead assembly as claimed in claim 1, wherein each printhead module includes an integrated circuit and at least one fiducial for aligning the printhead.

3. A printhead assembly as claimed in claim 2, wherein the integrated circuit is manufactured using MEMS techniques.

4. A printhead assembly as claimed in claim 1, further including an elastomeric layer located between the metal body and the silicon core.

5. A printhead assembly as claimed in claim 4, wherein the elastomeric layer is substantially uniform.

* * * * *